United States Patent [19]

Koepp et al.

[11] 4,301,524

[45] Nov. 17, 1981

[54] PROGRAMMABLE ALARM CLOCK

[75] Inventors: Ronald L. Koepp, Sunnyvale; Floyd F. Oliver, Los Altos; James V. Barnett, Cupertino, all of Calif.

[73] Assignee: Fairchild Camera and Instrument Corp., Mountain View, Calif.

[21] Appl. No.: 129,520

[22] Filed: Mar. 12, 1980

Related U.S. Application Data

[63] Continuation of Ser. No. 866,874, Jan. 4, 1978, abandoned.

[51] Int. Cl.[3] ..... G04B 23/00; G04C 21/16

[52] U.S. Cl. ..... 368/261; 368/251

[58] Field of Search ..... 368/72–74, 368/250, 251, 261, 28–30, 34

[56] References Cited

U.S. PATENT DOCUMENTS

| | | | |
|---|---|---|---|
| 3,813,533 | 5/1974 | Cone et al. | 58/152 R X |
| 3,816,730 | 6/1974 | Yamamoto et al. | 58/152 R X |
| 4,093,992 | 6/1978 | Kawamura et al. | 58/152 R X |
| 4,101,963 | 7/1978 | Reese et al. | 58/152 R X |
| 4,104,863 | 8/1978 | Kondo | 58/57.3 X |
| 4,104,865 | 8/1978 | Sasaki | 58/57.5 X |
| 4,107,916 | 8/1978 | Kondo | 58/57.5 X |

*Primary Examiner*—Vit W. Miska

*Attorney, Agent, or Firm*—Paul J. Winters; Ronald J. Meetin; Michael J. Pollock

[57] ABSTRACT

A programmable microcomputer controlled alarm clock has a multi-key input keyboard for setting the time of day, the month and date, and the alarm times of two or more independent alarms. Each alarm may be set to generate an alarm signal at a selected time on each day of two to six consecutive days of a seven-day period, the alarm sequence being automatically repeated each following seven-day period. In the normal operational mode, time of day is displayed until a month-and-date switch, an alarm-period or doze switch, or an alarm-enabling switch is actuated to display the respective date and alarm time. After the particular switch is actuated and the appropriate time information displayed, the clock returns to display time of day within several seconds.

7 Claims, 3 Drawing Figures

PROGRAMMABLE ALARM CLOCK

This is a continuation of application Ser. No. 866,874, filed Jan. 4, 1978, now abandoned.

BACKGROUND OF THE INVENTION

This invention relates to alarm clocks and particularly to a novel microcomputer-controlled solid-state alarm clock having a 10-key input keyboard for setting time, date, and the alarm times of two independently operating alarms that may be set to operate at any desired time at any day or days of the week.

The alarm clock of the invention is controlled by a microcomputer system, such as the F8 Microcomputer System manufactured by Fairchild Camera and Instrument Corporation. The Fairchild F8 Microcomputer System is a versatile family of components comprising a central processing unit to which is added associated components, such as program storage units, memory interfaces, peripheral input/output units, and memories, in accordance with the requirements of the user. The solid state alarm clock of the invention utilizes a 3850 central processing unit, a 3861 peripheral input/output unit, a 3853 memory interface, and a 2708 erasable PROM, all interconnected through a control line bus and the system 8-bit data bus. The CPU is operated by a two-megahertz crystal operated clock and the associated read-only memory is programmed so that the input/output ports of the system will accept the necessary input data and produce output displays of real time, alarm times, month and date, days of the week, and furthermore controls the audible alarm circuitry.

SUMMARY OF THE INVENTION

The alarm clock of the invention utilizes a programmed microcomputer responsive to a keyboard having numerical input keys and control switches to generate output displays of real time, "AM" (morning) or "PM" (afternoon), month and date, days of the week, alarm-period or doze time, and the alarm times of two or more independent alarms. Each alarm may be set to operate at any hour of any day or sequential days of the week. Each alarm is set by first switching the clock from a "RUN" mode to a "SET" mode, actuating an alarm-enabling switch for the alarm, and entering the desired alarm time into the keyboard. A switch for selecting AM or PM may then be actuated to select morning or afternoon alarm times. Another switch is operated to select the particular day or days of the weeks on which the alarm is to sound. The alarm times of the two alarms and the days of the week to which they may be set as visually displayed at any time by merely actuating the alarm-enabling switches. The visual displays revert to real time thereafter in a short period which is approximately five seconds in the preferred embodiment.

DETAILED DESCRIPTION OF THE PREFERRED EMBODIMENT

Figure 1:
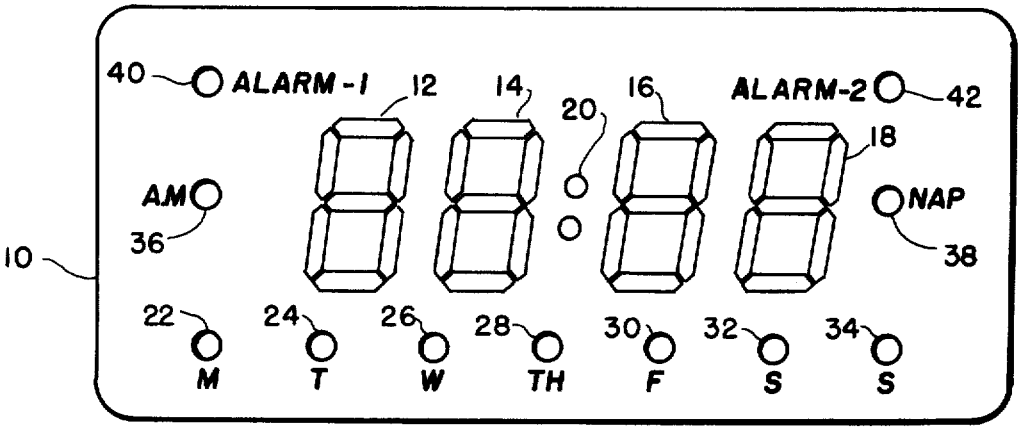
FIG. 1 is a plan view illustrating the display panel of the invention.

The preferred embodiment of the alarm clock includes the display panel 10 illustrated in FIG. 1. Display panel 10 includes four 7-segment numeric displays 12, 14, 16 and 18 with displays 12 and 14 displaying tens and units in hours and displays 16 and 18 displaying tens and units in minutes. Displays 12 and 14 are separated by two light-emitting diodes (LEDs) representing a colon 20. Positioned in a horizontal line below the numeric displays 12–18 in the panel 10 are seven LEDs 22, 24, 26, 28, 30, 32 and 34 which are respectively labeled with letters representing the days of the week. Located to the left of the numeric displays 12–19 is another LED 36 which, when lighted, designates that the displayed time is AM. Positioned to the right of the numeric displays 12–18 is an LED 38 labeled "NAP". When the clock is first placed in the "NAP" mode, NAP light 38 is on and displays 12–18 indicate a nap period up to ninety minutes, after which the clock is returned to its operating mode to display real time. After the selected nap period, the alarm sounds.

Positioned above the numeric displays 12–18 are LEDs 40 and 42, respectively labeled "ALARM-1" and "ALARM-2". Lamps 40 and/or 42 turn on when ALARMS-1 and/or -2 are turned on, as will be subsequently described.

Figure 2:
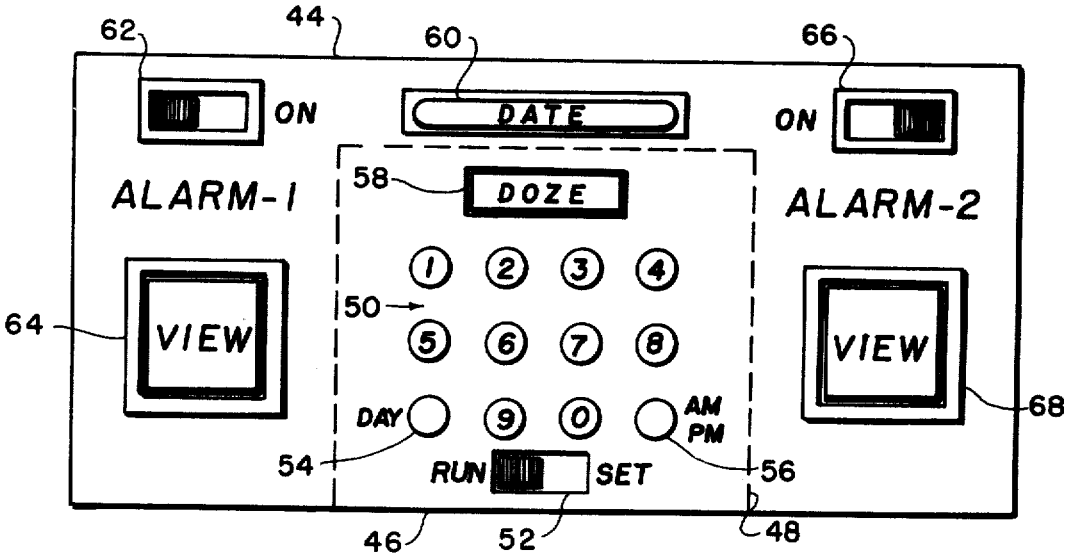
FIG. 2 is a plan view illustrating the keyboard and control panel of the invention.

FIG. 2 is a plan view of a preferred embodiment of the keyboard of the solid-state alarm clock and includes a panel 44 having a front edge 46 to which is hinged a cover panel 48 illustrated by the dashed lines. Enclosed beneath the hinged cover panel 48 is a 10-key input keyboard 50 having ten keys numbered "1" through "0". Also beneath the cover panel 48 is a SET/RUN switch 52, a DAY pushbutton switch 54 and an AM/PM pushbutton switch 56. Located at the top center area beneath the cover panel 48 is a DOZE switch 58. DOZE switch 58 is a spring-loaded pushbutton switch and is preferably positioned over a pin member protruding from the bottom surface of the cover panel 48 so that, when an alarm sounds, the operator may merely depress the top surface of the cover panel 48 to activate the DOZE switch 58 to provide an additional ten minutes before the alarm is again activated.

It will be appreciated that all input function switches that alter the time or date of the alarm clock are concealed beneath the cover panel 48 so that an accidental time, date or day change cannot take place.

Located above and outside the confines of the cover panel 48 is a pushbutton DATE switch 60 which, when depressed, displays the month and the date on the numeric displays 12–18 of FIG. 1. Five seconds after the DATE switch 60 has been released, the month and date display is extinguished and the displays 12–18 revert to real time.

Positioned to the left of the DATE switch 60 is the ON/OFF switch 62 associated with the first of the two independently operating alarms, and located below switch 62 and to the left of cover panel 48 is a large pushbutton switch 64 labeled "VIEW" which, when depressed, causes the numeric displays 12–18 of FIG. 1 to display the time at which ALARM-1 is set and the days for which it is set according to the LEDs 22–34. Located to the right of the DATE switch 60 and the cover panel 48 is an ON/OFF switch 66 and VIEW switch 68 associated with the second indpendently operating alarm. As in the case of the switch 64, VIEW switch 68, when depressed, causes the numeric displays 12–18, the AM/PM light 36 and the day lights 22–34 to indicate the time and the days for which ALARM-2 is set.

OPERATION OF THE CLOCK

Figure 3:
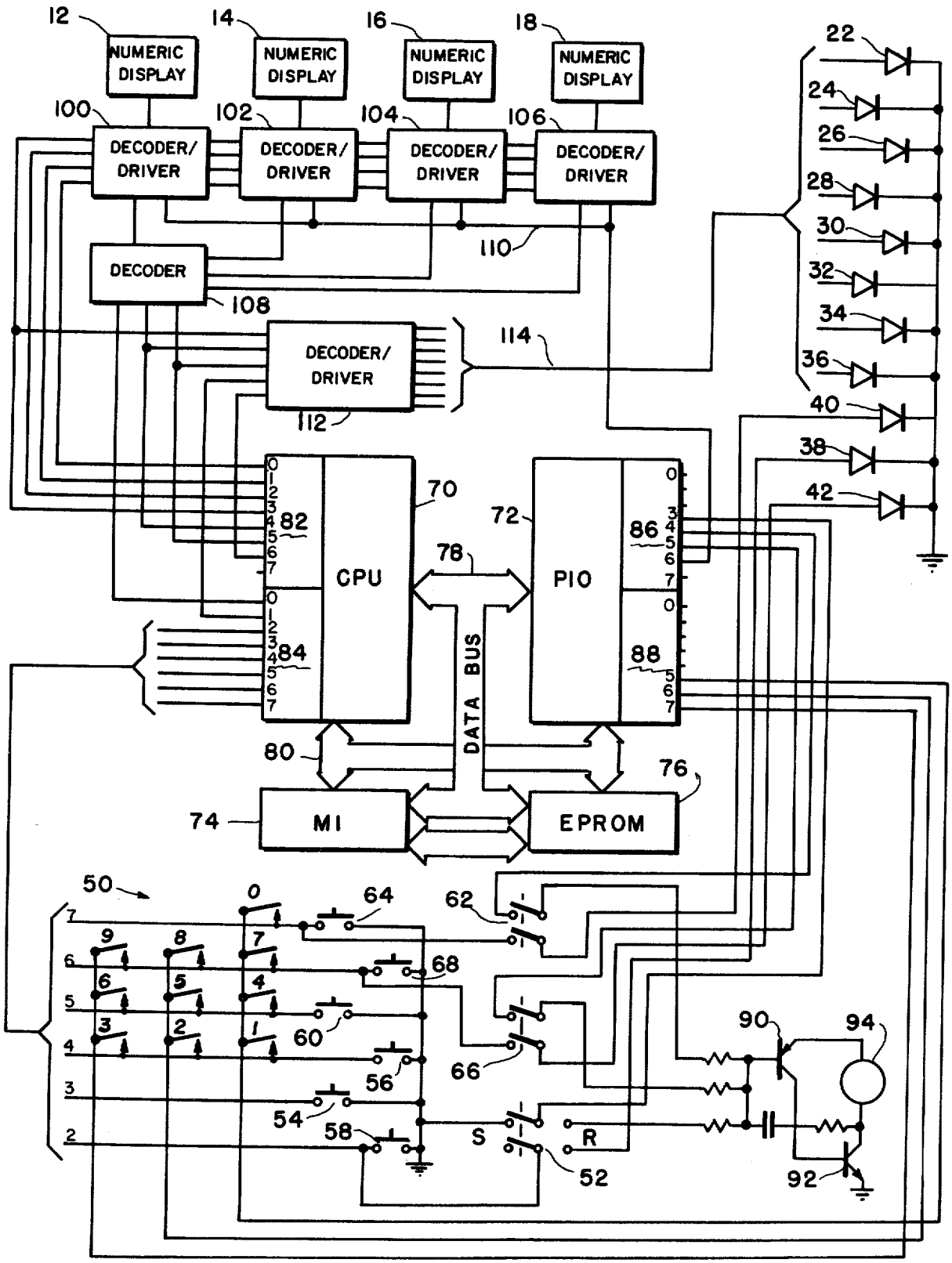
FIG. 3 is a block diagram of the circuitry of the invention.

Before proceeding with the detailed description of the circuitry of FIG. 3, there will be a brief description of the operation of the clock and the means by which it is set.

After A.C. power has been applied, cover panel 48 is hinged up and switch 52 is put into its SET position. When in the SET mode, the numeric displays 12–18 flash on and off to indicate readiness to receive input data. The time of day is then entered by the keyboard 50. The first number entered first appears on the display 18 and advances to the display 16, 14 and 12 as subsequent numbers are entered. Thus, the time of day is first entered, after which the AM/PM switch 56 is pushed to indicate morning or afternoon. The day SET switch 54 is then pressed an appropriate number of times to enter the correct day of the week on the lamps 22–34, after which switch 52 may be returned to the RUN position.

The month and day may be set into the clock by first moving switch 52 to the SET position and then depressing the pushbutton DATE switch 60. The numeric displays 12–18 flash until the first entry is made into the keyboard 50. If, for example, the clock is being set on October 15, the numeral entered into the keyboard 50 is 1015, indicating the tenth month and fifteenth day. After entry, switch 52 may be returned to the RUN position and the numeric displays 12–18 return to display real time.

The memory within the microcomputer system contains a four-year calendar, so that whenever it is desired to display the date of any month or year, it is merely necessary to depress DATE switch 60 whereupon the precise date appears on the numeric displays 12–18 and which return to display real time after approximately five seconds. If desired, the system may also be programmed to simultaneously display the present day of the week.

In its NAP mode, the clock may be set to produce its audible alarm at any ten-minute interval up to a maximum of ninety minutes. To set the clock for "NAP", cover panel 48 is lifted, switch 52 is moved to the SET mode, and DOZE button 58 is depressed once for each ten-minute nap interval desired. Each time the DOZE button 58 is depressed, an additional ten-minute interval will be indicated on the numeric displays 16 and 18 and the NAP light 38 will be turned on to indicate time in a down-counter within the circuitry. Switch 52 is then returned to the RUN mode and the numeric displays 12–18 again return to display real time. At the end of the nap period, the alarm will sound but the down-counter may be erased at any earlier time and the alarm silenced by pushing either the ALARM-1 or ALARM-2 button 64 or 68, respectively.

ALARM-1 and ALARM-2 are identically set by first moving switch 52 into the SET position, momentarily depressing the appropriate alarm switch 64 or 68, and entering the desired alarm time into the keyboard 50. The AM/PM switch 56 is then depressed to indicate the appropriate morning or afternoon time, and switch 52 may then be returned to its RUN position.

To change the alarm day sequence, switch 52 is first moved to its SET position, the appropriate alarm switch 64 or 68 is momentarily pushed, and the DAY switch 54 is then depressed to indicate the appropriate day on the lights 22–34. Thereafter, the alarm time is set through the keyboard 50 and the AM/PM is set by switch 56. If it is desired to set the alarm for a sequence of days rather than a single day, the DAY switch 54 may again be depressed at this point to add additional days on the display lights 22–34. Thus, upon first depressing the DAY button 54 after depressing the appropriate ALARM switch 64 or 68, all days previously entered are erased, and the single lamp 22, representing Monday, is turned on. Subsequent depressing of switch 54 switches the lights from lamp 22 to 24 up through 34, indicating a single day. However, after selecting a single day, the entering of an alarm time through the keyboard 50 and then second depressing of the DAY switch 54 add additional days so that the displays 22–34 may, if desired, indicate between one and seven days. Thereafter, switch 52 is returned to its RUN position.

Having entered desired alarm times, date and real time, switch 52 normally remains in the RUN position. To view the entered date, it is merely necessary to depress the pushbutton DATE switch 60 for a five-second display of the present date. Similarly, depressing VIEW switches 64 and 68 displays the alarm time and the days of the week at which ALARMs-1 and -2 are respectively set. When ALARM switch 62 is in its ON position, the audible alarm sounds at the particular time of day on the selected day of the week but the corresponding ALARM light 40 of FIG. 1 is on only on on the particular day or days selected for that alarm. Similarly, the ALARM 2 light 42 only indicates on those particular days that ALARM-2 has been selected.

DESCRIPTION OF THE CIRCUITRY

FIG. 3 is a block diagram of the circuitry of the solid-state alarm clock and includes a microcomputer which, in the preferred embodiment, is a Fairchild F8 Microcomputer System which includes a type 3850 central processing unit (CPU) 70, a type 3861 peripheral input-/output unit (PIO) 72, a type 3853 memory interface unit (MI) 74 and a type 2708 erasable programmable read-only memory (EPROM) 76. All data and address information is transferred between the CPU 70, PIO 72, MI 74 and EPROM 76 by an 8-line data bus 78 and the control functions applied through a suitable control bus 80. CPU 70 contains two 8-line input/output (I/O) ports 82 and 84, but since these are insufficient for all of the input and output functions of the clock, it is necessary to employ PIO 72 which includes two additional input ports 86 and 88. In the nomenclature adopted for the F8 Microcomputer System, ports 82 and 84 correspond to F8 I/O ports "0" and "1", respectively, and ports 86 and 88 correspond to F8 ports A and B, respectively. I/O ports 82, 84, 86 and 88 are 8-line, or bit, ports and are referred to herein as bits 0 through 7 corresponding to the F8 designation.

As illustrated in FIG. 3, the input keyboard 50, for entering real time, ALARM times and dates into the clock is comprised of switches that selectively interconnect bits 4, 5, 6 and 7 of port 84 with bits 5, 6, and 7 of port 88. The bit line 4 of port 84 is connected to switches for entering the numerals "1", "2" and "3", and is also coupled to one terminal of the AM/PM pushbutton switch 56, the opposite terminal of which is grounded. Similarly, the bit line 5 of port 84 is connected to switches for entering the numerals "4", "5", and "6" and is also connected to one terminal of the pushbutton DATE switch 60, the other terminal of which is grounded. Bit line 6 of port 84 is coupled to switches for entering the numerals "7", "8", and "9" and is also connected to one terminal of the pushbutton VIEW switch 68, the other opposite terminal of which is grounded. Bit line 7 from port 84 is coupled to a switch for entering "0" and is also coupled to one terminal of the pushbutton VIEW switch 64, the other terminal of which is grounded. When bit line 4 of port 84 sees correspondence with either bit lines 5, 6 and 7 of the port 88, the numbers "1", "2", or "3" are respectively entered. On the other hand, if bit line 4 sees ground potential through the switch 56, it records a change from PM to AM or vice-versa. Similarly, when bit line 5 of port 84 sees correspondence with lines 5, 6 and 7 of port 88, it respectively enters numerals "4", "5" and "6" into CPU70. However, if it is grounded through the switch 60, the DATE display is actuated. When bit line 6 of port 84 is switched into correspondence to lines 5, 6 or 7 of port 88, a numeral "7", "8", or "9" is respectively entered into the system but if ground potential is applied through switch 68, the numeric displays 12–18 show the time of ALARM-2. Similarly, if bit line 7 of port 84 is grounded through switch 64, the displays 16–18 show the time of ALARM-1. Bit line 3 of port 84 is connected to one terminal of the pushbutton DAY switch 54, the other terminal of which is grounded. Bit line 2 of port 84 is coupled to one terminal of the pushbutton DOZE switch 58, the opposite terminal of which is grounded.

The ALARM-1 and ALARM-2 ON/OFF switches are double-pole single-throw slide switches as shown in FIG. 3. Bit line 7 of port 84 is coupled to one pole of switch 62, the other terminal of which is connected through a simple transistor amplifier to the LED 40, the cathode of which is grounded. The second pole of switch 62 is connected to the bit line 4 of port 86, and the second terminal of this pole of switch 62 is connected to a transistor tone generator, as will be subsequently described. Therefore, bit line 7 of port 84 provides the signal that ALARM-1 is set for this particular day of the week, whereas bit line 4 of port 86 provides an output at the precise hour and minute to which ALARM-1 is set.

ALARM-2 is controlled in the same manner. Bit line 6 from port 84 is connected to one terminal of one pole of the switch 66, the other terminal of which is connected through a simple amplifier to the LED 42, the cathode of which is grounded. The second pole of the ALARM-2 switch is connected between bit line 5 of port 86 and the input to the tone generator.

The SET/RUN switch 52 is a double-pole double-throw switch. Bit line 3 of port 86 is coupled to the common terminal of one pole, the SET terminal of which is grounded and the RUN terminal of which is coupled to the tone generator. The common terminal of the second pole of switch 52 is coupled to bit line 2 of port 84. The SET terminal of this pole is open, and the RUN terminal is connected through a simple amplifier to the NAP LED 38, the cathode of which is grounded. Therefore, switch 52 not only controls the SET and RUN functions of the clock, but also actuates the NAP LED indicator 38. The bit line 3 of port 86 switches the clock into its SET mode when grounded through switch 52 and provides a tone output for the NPA function when ungrounded.

The tone generator previously referred to is well-known and includes a PNP transistor 90, the collector of which is connected to the base of an NPN transistor 92, whose emitter is grounded. The collector of transistor 92 is coupled through an 8-ohm speaker 94 to the emitter of transistor 90 and to a positive 5-volt source. The input signals from the switches 62 and 66 are applied to the base of transistor 90 through isolation resistors having typical values of 50 kiloohms and the NAP input from switch 52 is applied to the base of transistor 90 through a resistance of typically 82 kiloohms. The base of transistor 90 is coupled through a series RC circuit to the collector of transistor 92, and a satisfactory tone is obtained with RC values of typically 100 ohms and 0.33 microfarads, respectively. If desired, the tone generator of the clock may be replaced with an electronic relay, such as a triac circuit, for providing AC power to an output receptacle. Thus, the clock may be used as a programmable time as well as a clock.

The numeric output display is formed by 7-segment LED units 12, 14, 16 and 18 which, in the preferred embodiment, are Fairchild type FND-507. These LED units 12–18 are driven by decoder/drivers 100, 102, 104 and 106, respectively. These driver units, which may be Fairchild type 9374, receive their binary input from bit lines 0–3 of the input/output port 82. The latching input to each of the drivers 100–106 is received from a 4-line decoder 108 which receives its binary inputs from bit lines 4 and 5 of the port 82 and the bit line 0 of the port 84.

As previously indicated, the numeric displays 12–18 flash on and off when switch 52 is in its SET mode. This flashing function is obtained from bit line 6 of the port 86 and is transmitted via line 110 to the blanking input terminals of latches 100–106.

The LEDs 22–34 that represent days of the week, and the AM/PM LED 36 are controlled by a BCD to 7-segment decoder/driver 112 which, in the preferred embodiment, is a Fairchild type 9334. The eight output terminals of driver 112 are coupled through an 8-conductor bus 114 to the anodes of the lamps 22–36, the cathodes of which are grounded. The binary input to the decoder/driver 112 is obtained from bit lines 3, 4, 5 and 6 of the port 82 and bit line 1 of the port 84.

It is apparent that in order to duplicate and operate the solid state keyboard clock described herein, it is necessary to program a similar microcomputer in a manner identical with the program used herein. Therefore, having described the operation and the construction of the clock using the Fairchild F8 Microcomputer System, the F8 read-only memory code in machine language is given below.

MACHINE CODE FOR F8 MICROCOMPUTER SYSTEM

```
M00 – 44F
M0000 = 20 3F 50 40 OB 70 5C 30
M0008 = 81 FA 70 BE BA 71 B6 67
                                        POWER-UP
M0010 = 68 5D 5D 5D 6F 5C 66 20
M0018 = FF 5C 65 5C 2B 29 00 88
M0020 = 63 6D 70 CC 84 04 29 03
M0028 = A0 45 21 70 B4 67 6D A4
M0030 = 5C 70 E1 A1 56 50 21 EO
M0038 = 84 23 74 58 40 14 50 78         RUN-SET
M0040 = F0 84 04 20 30 59 74 F0
M0048 = 84 04 20 28 59 72 F0 84
M0050 = 04 20 20 59 63 68 70 5D
M0058 = 5C 65 6E 5C 67 6D 78 FC
M0060 = 84 04 29 01 58 /74 F6 84
M0068 = OA 63 68 2B 71 5C 65 6E
M0070 = 70 5C 70 C8 94 04 20 38         RUN
M0078 = 59 70 07 63 6C 70 5E 5E
```

-continued

| MACHINE CODE FOR F8 MICROCOMPUTER SYSTEM | |
|---|---|
| M0080 = 20 38 5C 29 00 F0 FF FF | |
| M0088 = 20 38 59 OB 62 6D 5D 5D | |
| M0090 = 29 00 20 FF FF FF FF FF | CAL. DATA |
| M0098 = 02 04 06 09 11 FF FF FF | |
| M00A0 = 62 6D 3C 94 1D 20 30 5D | |
| M00A8 = 70 CA 84 02 3A 70 C8 84 | |
| M00B0 = 02 38 70 C7 84 02 37 3C | INTERRUPT |
| M00B8 = 94 08 20 3C 5E 5C 29 02 | ROUTINE |
| M00C0 = D8 63 6E 3E 70 CC 84 02 | |
| M00C8 = 3C 29 00 20 / 2B 2B 2B 2B | |
| M00D0 = 77 6F 4C 13 50 81 03 71 | |
| M00D8 = 50 40 5C 29 / 03 60 / 3C 20 | |
| M00E0 = 63 68 4D 50 4C 51 C0 84 | DISPLAY OUTPUT |
| M00E8 = 08 70 52 53 0B 90 08 2B | |
| M00F0 = 2B 2B 2B 2B 49 0B 73 5B | |
| M00F8 = 74 54 4B 18 15 CD 18 B0 | |
| M0100 = 20 01 B1 70 B1 3B 34 94 | |
| M0108 = F2 70 B0 2B 49 0B 2B 2B | |
| M0110 = 6C 4C 21 80 6F CC 52 78 | |
| M0118 = 50 77 51 2B 2B 41 18 15 | |
| M0120 = 53 42 21 01 C3 18 EO BC | |
| M0128 = BC BC 72 B1 BC BC 70 B1 | |
| M0130 = BC BB 42 12 52 31 30 94 | |
| M0138 = E5 29 03 A0 / FF FF FF FF | |
| M0140 = 6B 4E 15 CC 25 13 94 06 | PARTIAL CAL. |
| M0148 = 6B 70 5E 71 5E 69 70 5E | |
| M0150 = 71 5C 1C FF FF FF FF FF | |
| M0158 = 70 CA 84 03 90 40 63 6D | |
| M0160 = 70 CC 84 03 90 38 03 25 | |
| M0168 = 05 94 06 49 0B 70 07 5C | |
| M0170 = 62 68 71 5C 6C 74 5E 20 | |
| M0178 = 10 50 4E B1 73 5E 70 B5 | |
| M0180 = A5 21 70 13 5E 91 19 4C | |
| M0188 = 1F 5D 4D 3E 4C 94 F5 6B | KEYBOARD SCAN |
| M0190 = 4C 13 5D 3E 94 E5 6F 7F | AND SCROLL |
| M0198 = 5C 63 6D 70 50 90 33 68 | |
| M01A0 = 4C 24 F6 92 03 70 5C 6F | |
| M01A8 = 4C 18 1F 68 CC 84 EB 4C | |
| M01B0 = 6F 5C 03 1F 07 75 57 2B | |
| M01B8 = 2F 49 0B 6A 4D 5E 5E 4D | |
| M01C0 = 5E 5E 4D 5E 62 6F 4C 50 | |
| M01C8 = 49 OB 68 40 5C 63 6D 75 | |
| M01D0 = 5C 70 C7 94 03 70 07 03 | |
| M01D8 = 50 40 25 05 94 0C 49 OB | |
| M01E0 = 6B 70 5E 5E 5E 7B 5C 71 | |
| M01E8 = 5A 40 25 01 94 08 49 OB | |
| M01F0 = 6B 70 5E 5E 5E 29 02 88 | |
| M01F8 = 63 6D 70 CC 84 04 29 02 | |
| M0200 = 85 20 3C 50 2B 2B 46 50 | |
| M0208 = 21 10 84 07 49 OB 6C 4C | |
| M0210 = 18 5C 40 21 04 84 06 63 | |
| M0218 = 69 71 CC 5C 2B 2B 2B 2B | |
| M0220 = 78 F6 84 61 49 25 38 94 | |
| M0228 = 13 49 OB 6F 4C 13 50 81 | DAYS PROGRAM |
| M0230 = 03 71 50 40 5C 63 6A 49 | |
| M0238 = 5C 90 4A 63 6A 4C 18 1F | |
| M0240 = 09 84 06 70 5D 5D 90 EE | |
| M0248 = 49 OB 70 4D CD CD CD 84 | |
| M0250 = D9 63 6B 70 CC 94 0F 71 | |
| M0258 = 5C 49 OB 70 5D 5D 5D 5C | |
| M0260 = 6F 71 5C 90 20 4C 25 02 | |
| M0268 = 84 OA 72 5D 49 OB 6F 4C | |
| M0270 = 63 6C 5C 63 6C 4C 13 50 | |
| M0278 = 81 03 71 50 40 5C 49 OB | |
| M0280 = 6F 40 EC 5C 2B 29 00 EO | |
| M0288 = 70 C6 84 FA 29 01 F8 / FF | |
| M0290 = 4C 24 06 92 06 70 5D 4C | |
| M0298 = 1F 5C 69 4E 15 CC 51 2A | |
| M02A0 = 00 98 40 8D 84 13 40 8D | |
| M02A8 = 84 0F 32 94 F9 41 25 32 | CALENDAR |
| M02B0 = 90 15 28 02 C8 90 0F FF | |
| M02B8 = 41 25 29 84 F6 90 07 FF | |
| M02C0 = 41 25 31 84 EE 29 00 D0 | |
| M02C8 = 6A 4C 1F 5C 24 06 92 06 | |

-continued

| MACHINE CODE FOR F8 MICROCOMPUTER SYSTEM | |
|---|---|
| M02D0 = 70 5D 4C 1F 5C 29 01 40 | |
| M02D8 = 63 69 70 CE 94 12 70 CC | |
| M02E0 = 94 03 90 16 3C 84 03 90 | |
| M02E8 = 11 65 6E 78 5C 90 12 70 | DOZE AND NAP |
| M02F0 = CC 94 06 79 5D 3C 90 02 | |
| M02F8 = 3C 70 CA 84 04 2B 83 EA | |
| M0300 = 67 68 4C 1F 5C 24 F6 92 | |
| M0308 = 40 70 5D 4C 1F 5C 24 FA | |
| M0310 = 92 37 70 5D 4C 1F 5D 4E | |
| M0318 = 24 FF 92 18 4C 24 FD 82 | |
| M0320 = 1P 67 68 4D CD 94 22 4C | TIME KEEPING |
| M0328 = 24 FE 92 1D 67 6C 4C 18 | |
| M0330 = 5C 90 1B 4C 24 F6 92 11 | |
| M0338 = 70 5D 4C 1F 5C 90 0A 67 | |
| M0340 = 68 70 5D 5D 5D 5E 1F 5D | |
| M0348 = 49 OB 29 03 60 / 70 CC 84 | |
| M0350 = F8 62 6B 4E 15 CE 50 74 | TEST FOR PM/AM |
| M0358 = 52 68 4C 1F 5C 29 02 90 | CHANGE |
| M0360 = 67 6F 4C 50 66 6F 4C FO | |
| M0368 = 84 16 74 50 68 66 4C 51 | |
| M0370 = 67 4D 18 1F C1 94 09 30 | |
| M0378 = 94 F4 65 6E 71 15 5C 2B | ALARMS |
| M0380 = 67 6F 4C 50 65 6F 4C F0 | COMPARE |
| M0388 = 84 16 74 50 68 65 4C 51 | |
| M0390 = 67 4D 18 1F C1 94 09 30 | |
| M0398 = 94 F4 65 6E 72 15 5C 2B | |
| M03A0 = 70 51 65 6E 4C 51 63 4C | |
| M03A8 = 50 70 C7 94 11 67 6D 4C | |
| M03B0 = 21 08 84 OA 40 2B 13 13 | |
| M03B8 = 21 40 50 90 03 70 50 40 | FLASH CONTROL |
| M03C0 = E1 55 B4 29 04 20 | |
| M0420 = 70 50 63 69 4E CC 84 05 | |
| M0428 = 74 50 90 15 67 6F 4C 51 | |
| M0430 = 66 FC 84 04 78 15 50 65 | ALARM TONES OUTPUT |
| M0438 = 4C F1 84 05 74 15 EO 50 | ALARM-1, |
| M0440 = 40 21 FC B1 1B 29 04 20 | ALARM 2 |
| M0448 = 30 94 FE 29 04 20 FF FF | NAP LIGHTS |

Having thus described our invention, what is claimed is:

1. A programmable clock having: a microcomputer system for storing and processing time-related data and for controlling the display of time-related data; input keyboard means operable in a SET mode for entering time-related data into the microcomputer system, said keyboard means including a plurality of numeric input keys; switching means coupled to the microcomputer system for switching said clock between the SET mode and an operational RUN mode; output display means controlled by the microcomputer system for displaying time-related data thereon; and alarm means controlled by the microcomputer system for generating alarm signals; characterized in that said alarm means include M independently operable alarm circuits, where M is a positive integer greater than one, each alarm circuit operable on a repetitive seven-day basis for generating during a seven-day period according to an alarm-signal sequence an alarm signal at a selected alarm time on each day of N consecutive days of the seven-day period, where N is an integer varying from two through six, the alarm-signal sequence automatically repeatable during each following seven-day period.

2. A programmable clock as in claim 1 further characterized in that said keyboard means included M alarm-enabling switches corresponding on a one-to-one basis to said M alarm circuits, the selected alarm time of each alarm circuit enterable during the SET mode by first actuating the corresponding alarm-enabling switch and then actuating selected keys of said input keys, each selected alarm time displayable on said display means by actuating said corresponding alarm-enabling switch during the RUN mode.

3. A programmable clock as in claim 2 further characterized in that said keyboard means includes a day-selection switch and said display means includes seven individual displays to indicate the seven days of the week respectively, the single day enterable during the SET mode for each alarm circuit by actuating said day-selection switch a specified number of times before entering the selected alarm time and the last N minus one days of the N consecutive days enterable during the SET mode for each alarm circuit by further actuating the day-selection switch N minus one times after entering the selected alarm time, the N consecutive days displayable on said individual displays by actuating the alarm-enabling switch for each alarm circuit during the RUN mode.

4. A programmable clock as in claim 3 further characterized in that actuation during the SET mode of the day-selection switch after actuation of the alarm-enabling switch for each alarm circuit erases all previous day information associated with that alarm circuit.

5. A programmable clock as in claim 1 further characterized in that said display means includes M alarm-day displays corresponding on a one-to-one basis to said M alarm circuits, each alarm-day display being actuated on a particular day only if the corresponding alarm circuit is programmed to generate an alarm signal on that particular day.

6. A programmable clock as in claim 1 further characterized in that said display means includes a plurality of numeric displays which flash on and off in the SET mode to indicate readiness to receive time-related data.

7. A programmable clock as in claim 1 further characterized in that time of day is entered by actuating selected keys of said input keys during the SET mode.

* * * * *